US005767786A

United States Patent [19]

Lopatukhin et al.

[11] Patent Number: 5,767,786

[45] Date of Patent: Jun. 16, 1998

[54] METHOD OF PROVIDING VOICE MEMOS IN A SELECTIVE CALL RECEIVER

[76] Inventors: Eugene Lopatukhin, 13 via de Casas Sur#103, Boynton Beach, Fla. 33426; Frank Falcone, 17039 42nd Rd. North; Christopher Kincaid, 14407 75th La. North, both of Loxahatchee, Fla. 33470; Karen M. Holmes, 640 NE 20th La., Boynton Beach, Fla. 33435

[21] Appl. No.: 716,964

[22] Filed: Sep. 20, 1996

[51] Int. Cl.[6] ..... G08B 5/22

[52] U.S. Cl. ..... 340/825.44; 340/825.52

[58] Field of Search ..... 340/825.44, 825.15, 340/825.36, 825.52; 455/31.3

[56] References Cited

U.S. PATENT DOCUMENTS

| | | | |
|---|---|---|---|
| 4,872,005 | 10/1989 | De Luca et al | 340/825.44 |
| 4,885,577 | 12/1989 | Nelson | 340/825.44 |
| 5,283,818 | 2/1994 | Klausner et al. | 379/67 |
| 5,355,126 | 10/1994 | Nelson et al. | 340/825.44 |
| 5,412,719 | 5/1995 | Hamamoto et al. | 340/825.44 |
| 5,572,576 | 11/1996 | Klausner et al. | 379/67 |
| 5,654,942 | 8/1997 | Akahane | 340/825.44 |
| 5,697,060 | 12/1997 | Akahane | 340/825.44 |

OTHER PUBLICATIONS

Voice Memory Pager Brochure, Copyright 1990, Motorola, Inc., 4 pgs.

*Primary Examiner*—Brian Zimmerman
*Assistant Examiner*—Edward Merz
*Attorney, Agent, or Firm*—John H. Moore

[57] ABSTRACT

A method, in a SCR (Selective Call Receiver) (10), for providing to a user of the SCR (10) a voice memo in explanation of a received message. The SCR stores distinctive data (63) and a user-generated voice memo (67) that relates to the distinctive data. The voice memo (67) and the distinctive data (63) are stored in the SCR in association with each other. When a subsequent transmitted message (73) containing matching distinctive data is received, the SCR can annunciate the stored voice memo (67) in explanation of the subsequent message. Another feature allows voice memos to be stored and annunciated to explain the reason for alarms that are generated at times selected by the user.

16 Claims, 6 Drawing Sheets

METHOD OF PROVIDING VOICE MEMOS IN A SELECTIVE CALL RECEIVER

FIELD OF THE INVENTION

This invention is directed to selective call receivers (referred to herein as SCR's), and particularly to a method for supplying helpful information to the user of an SCR.

BACKGROUND OF THE INVENTION

SCR's have become very popular with people who need to maintain efficient and reliable communication with others. A relatively simple SCR is capable of receiving and storing a telephone number that has been sent to the SCR by a provider of communication services. The SCR alerts its user to the fact that a message (a telephone number in this case) has been received and is available to be displayed. The user typically then causes the SCR to display the message, after which the user places a telephone call to the number which is displayed on his SCR.

In some situations, the user may recognize the displayed telephone number as that of a spouse, co-worker, etc. At other times, the user may have forgotten who is associated with that telephone number, especially since some people have more than one telephone number, such as a home number, a work number, a hotel number, a cellular telephone number, and so forth. It would be helpful if the user's SCR could recognize a received telephone number, or other form of distinctive data, and inform the user of the identity of the person who originated the message, or the identity of the location from which the message was sent.

An associated problem arises with users who like to set their SCR's to sound an alarm at certain designated times. If the user frequently sets his SCR to sound multiple alarms to alert him to multiple events, he may forget which event he is being alerted to when the alarm is sounded. It would be most helpful if the user could be automatically informed as to the reason for any alarm that is sounded.

DESCRIPTION OF THE PREFERRED EMBODIMENT

Figure 1:
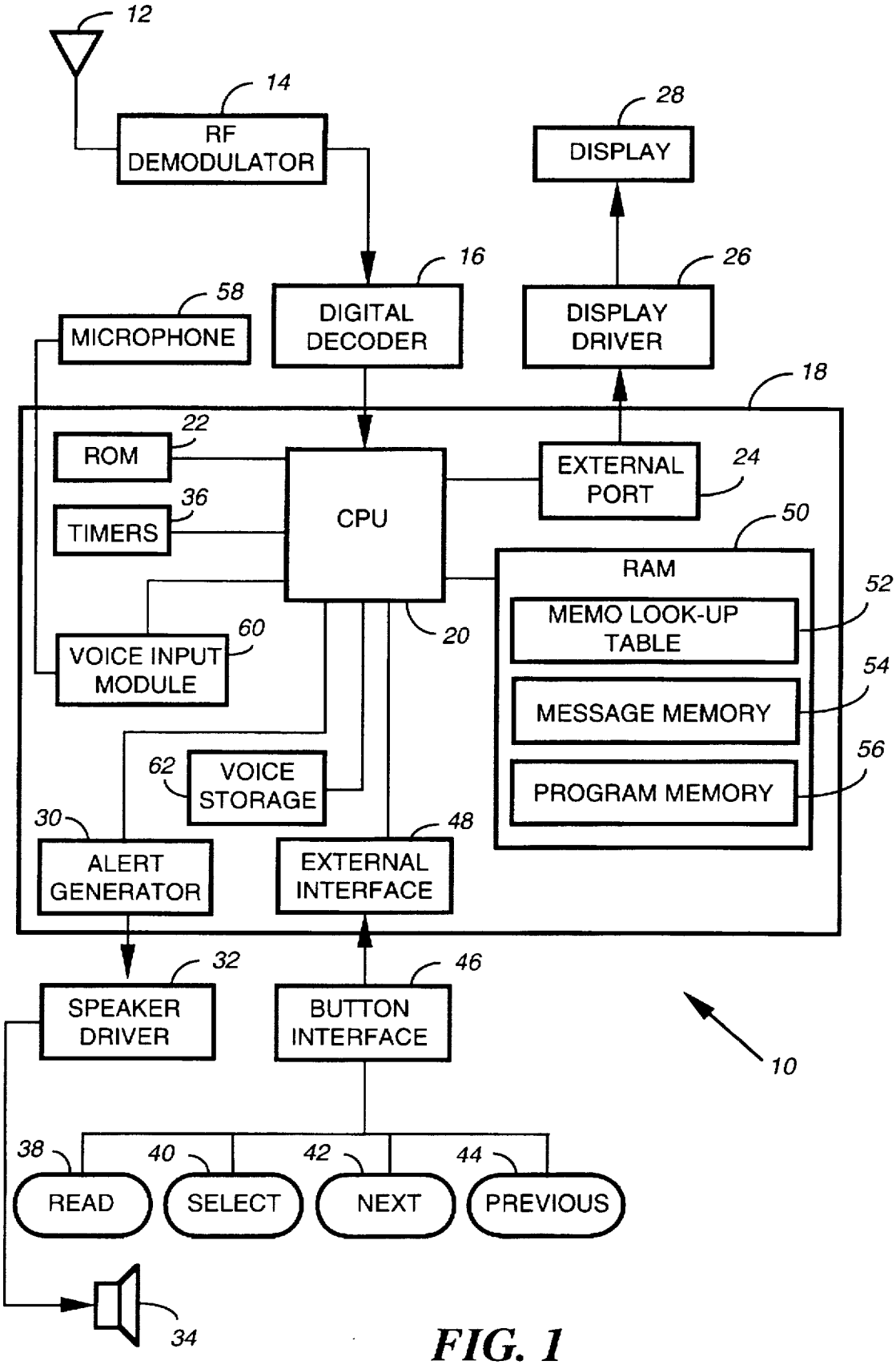
FIG. 1 is a block diagram of a SCR that is constructed to operate according to the invention.

Referring to FIG. 1, a SCR 10, constructed to operate in accordance with the invention, is shown in block diagram form. Many of the individual hardware elements in the SCR 10 are conventional and will, therefore, not be discussed in great detail.

The illustrated SCR 10 includes an antenna 12, an RF demodulator 14 and a digital decoder 16 for receiving and decoding incoming messages that include data. This data may be in the form of numbers (such as, but not limited to, telephone numbers), alpha-numeric text or voice data. In the exemplary operation described herein, it is assumed that the message being received by the SCR 10 includes a telephone number.

Messages received by the antenna 12 are demodulated by the conventional demodulator 14 to provide demodulated analog data as an input to the decoder 16 which may also be of conventional construction.

The signal output from the decoder 16 is decoded digital data that is applied as an input to a processor 18 which may be, for example, a type MC68HC05 processor made by Motorola, Inc. The processor 18 is programmed to cause the SCR 10 to operate according the invention, as discussed later.

The processor 18 includes a CPU (Central Processing Unit) 20 and a ROM (Read Only Memory) 22 which stores an instruction program for the CPU. The processor also includes an external port interface 24 for coupling signals from the CPU 20 to a display driver 26. The latter device drives a display 28, which may be a conventional liquid crystal display, for displaying decoded messages To generate a user alert upon receipt of a message, the CPU is coupled to an alert generator 30 whose output is coupled to the input of a speaker driver 32. A speaker 34 is coupled to the output of the driver 32 for generating an audible alert upon receipt of a message that is directed to the SCR 10.

Timers 36 are coupled to the CPU 20 to give a time base for collecting data from the digital decoder 16 at precise intervals, and they also time the duration for alerts.

To allow the user to control various functions of the SCR 10, a user control is included. In the illustrated embodiment, the user control takes the form of user actuatable buttons entitled Read 38, Select 40, Next 42 and Previous 44 that are coupled to the CPU via a button interface 46 and an external port interface 48. The buttons may be used to cause a received message to be shown on the display 28 (by use of the Read button 38), to scroll through messages using the buttons 42 and 44, to exit reading messages using the Select button 40, and for other functions that are related to the invention, as will be described later.

The processor 18 also includes a RAM (Random Access Memory) 50 that comprises the following stored elements: a memo look-up table 52, message memory 54 and program memory 56.

The message memory 54 stores messages that have been received and decoded. The program memory 56 acts as a scratch pad memory for temporary storage of new messages (before being stored in message memory 54) or the results of computations made by the CPU 20.

The memo look-up table 52 contains information that is used in operating the SCR 10 in accordance with a preferred method of operation, as will be described later.

Also included in the SCR 10 is a microphone 58 that is coupled to the input of a conventional voice input module 60. The purpose of the microphone 58 is to permit the user to speak a voice memo that the voice input module 60 receives and converts to a form that can be understood by the CPU 20. Under control of the CPU 20, the voice memo is stored in a conventional voice storage element 62 for later playback on the speaker 34. The voice storage element 62 and the voice input module 60 may be discrete elements as shown, or they may be combined into a single unit. They are available from ISD, Inc., San Jose, Calif.

In operation, the SCR 10 receives a first message that is transmitted to it. That first message includes what is referred to herein as distinctive data. Examples of distinctive data are a telephone number, a name, or other data that is distinctive with respect to the originator of the message, the location from which the message was sent, or any other parameter of interest.

In some cases, the transmitted message will include only a telephone number, in which case the message and the distinctive data are identical. In other cases, the transmitted messages will include a telephone number or a name embedded in the text of a longer message, such as "Call me at 734-8000.".In the latter example, the distinctive data is "734-8000".

According to a preferred method of operation, after the SCR 10 receives a first transmitted message that includes distinctive data, the SCR 10 displays the received message and asks the user, via a prompt on the display 28, whether the user desires to create a voice memo that relates to the received message. If the user assents, the user speaks, into the microphone 58, a voice memo that relates to the first transmitted message. The CPU 20 causes that voice memo to be stored the voice storage element 62 for later play back. The voice memo is stored in element 62 such that it remains associated with the distinctive data that was included in the first message. That voice memo can then be annunciated later to explain a subsequently received message that includes the same distinctive data.

Figure 2:
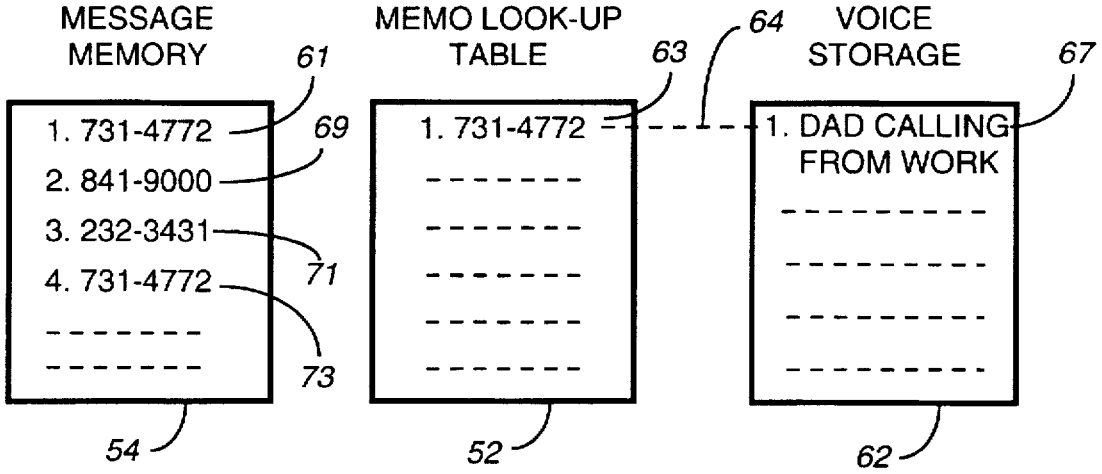
FIG. 2 is a schematic representation of portions of the SCR's memory, showing exemplary stored information.

An example will illustrate the preferred process. Assume that a first message 61 consists only of the telephone number "731-4772".That message is stored in the message memory 54 and, upon user demand, is shown on the display 28. The distinctive data 63 included in the message 61, "731-4772", is stored in location 1 in the memo look-up table 52, as shown in FIG. 2.

Assume further that the user does not initially realize that the telephone number "731-4772" is his father's telephone number at work. When the user places a telephone call to "731-4772", he learns that this is the telephone number of his father's workplace. After finishing the telephone call, the user decides to enter a voice memo to explain the significance of that telephone number. To do this, the user calls up the voice memo entry function of the SCR 10 using one of the control buttons, and speaks "Dad calling from work" into the microphone 58. That statement is stored as a voice memo 67 in location 1 in the voice storage element 62. The CPU 20 establishes a link (represented by dashed line 64) between the stored voice memo 67 and the distinctive data 63 that the voice memo is associated with. This link can be established using conventional software pointers that are well known to those skilled in the art.

Assume now that the user calls the telephone number indicated in the first message, but the telephone was not answered and the user deletes the first message. This causes the first message 61 to be deleted from the message memory 54, but the distinctive data 63 in the first message is retained in the memo look-up table 52. Likewise, the associated voice memo 67 remains stored in voice storage element 62.

The SCR 10 may then receive and store transmitted messages 69 and 71 which are displayed in the usual manner and without the user generating a voice memo for either of them. Later, the user's father sends to the SCR 10 a second message 73 having distinctive data that is identical to the first message, i.e., the telephone number "731-4772".The CPU 20 examines the second message 73 to look for a match between the distinctive data in the first and second messages. In this case, a match is found. The CPU 20 interprets this match as meaning that the voice memo 67, previously stored in association with the first message's distinctive data 63, should also be linked to the second message 73 (and to any subsequent messages containing the same distinctive data).

When the CPU 20 causes the second message 73 to be displayed, it preferably also causes the generation of a user-discernible indication that a stored voice memo relates to the displayed message and is available for annunciation. Preferably, the user-discernible indication is an icon that is shown on the display 28. In this way, the user is alerted to the fact that a stored voice memo is available to be played back in explanation of the second message. If the user desires to hear the voice memo, he presses the Select button 40, whereupon the CPU 20 causes the voice memo 67 to be annunciated via the speaker 34.

The forgoing example illustrates that the method of this invention preferably includes displaying the first transmitted message 61 before receiving a user-generated voice memo 67 that relates to the first message. After receiving the voice memo 67, the SCR stores it, and the distinctive data included in the first message, in association with each other. Later, the SCR receives and displays a second transmitted message 73 that includes the same distinctive data that was included in the first message. The stored voice memo 67 is associated with the distinctive data included in the second transmitted message, and that voice memo is preferably annunciated, in explanation of the second transmitted message 73, while the second transmitted message is being displayed.

Figure 3A:
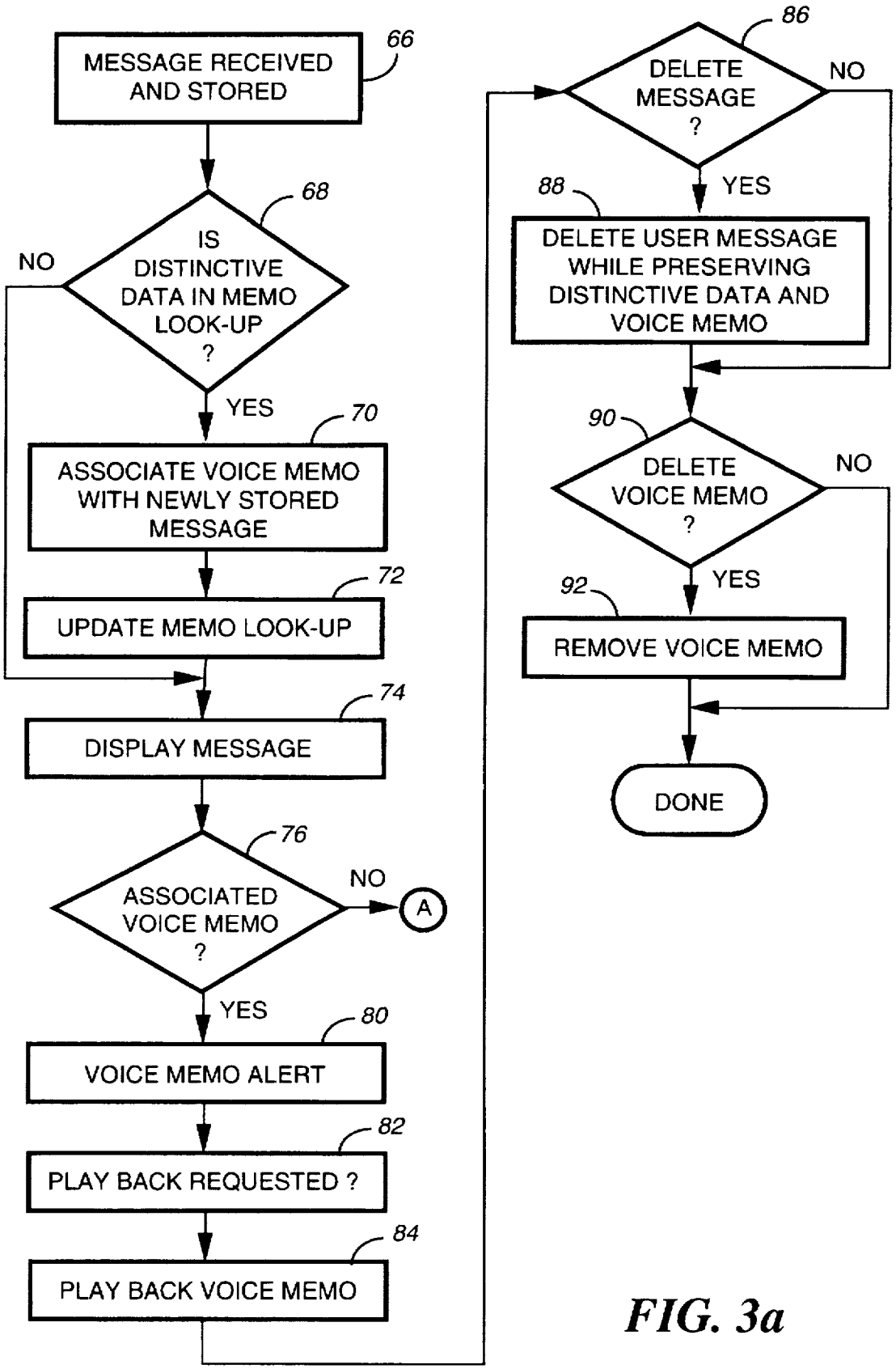
FIGS. 3A, 3B, 4 and 5 are flow charts showing how the SCR's CPU is programmed to carry out various aspects of the invention.
Figure 3B:
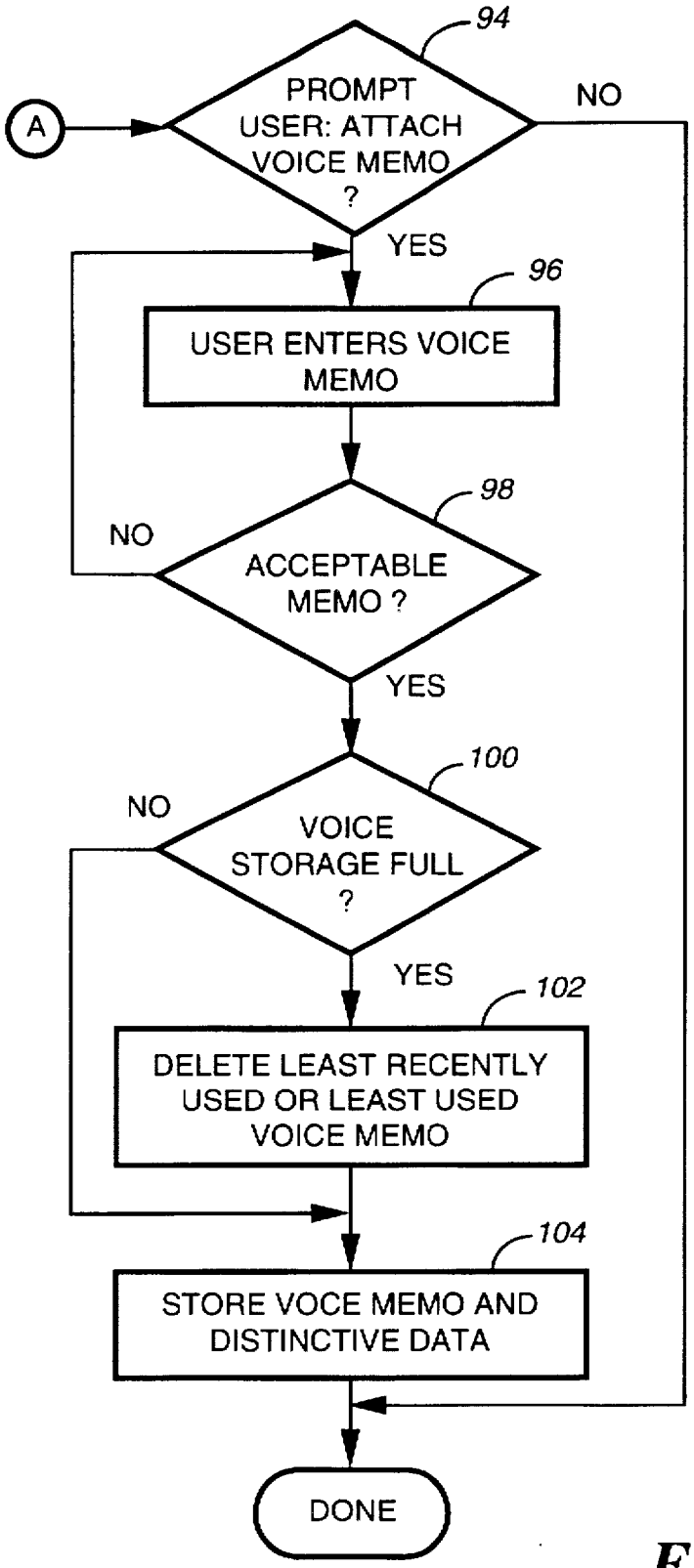

The way in which the SCR's CPU 20 is preferably programmed to carry out part of the invention is shown in the flow chart of FIGS. 3A and 3B. At step 66 (FIG. 3A), a message transmitted by the service provider is received by the SCR 10 and stored in its message memory 54. At step 68, a determination is made as to whether any distinctive data in the received message matches any distinctive data previously stored in the memo look-up table 52. If a match is found, this means that a previous message, having matching distinctive data, was received and that a voice memo was stored in association with it. Step 70 causes that same stored voice memo to be associated with the present message, meaning that that voice memo is identified by the CPU as being available for annunciation to explain the present message.

The next step 72 causes the memo look-up table 52 to be updated in a way that indicates which voice memo can be deleted in case the voice storage element 62 is full. For example, the CPU can store an indication of the most recently used voice memo to ensure that it does not become deleted. Alternately, the CPU can store an indication of the number of times each voice memo was annunciated and, when additional room is needed in the voice storage element 62, it can delete the voice memo that was most infrequently used. The stored voice memo can also be deleted on a first in-first out basis.

In step 74, the present message is displayed on the display 28, as in response to the user pressing the Read button 38.

Referring back to step 68, if the present message does not contain distinctive data that matches distinctive data previously stored in the memo look-up table, then the program proceeds from step 68 to step 74 for displaying the present message without associating a voice memo with it.

Step 76 asks whether a stored voice memo is associated with the present message. If a previously stored voice memo became associated with the present message per step 70, the answer is "yes", and the program proceeds to step 80 where a voice memo alert is generated to inform the user that a stored voice memo is available to provide information concerning the present message. The alert can be an audible alert, or preferably, an icon shown on the display 28, or both. If the user indicates that he wishes to play back the stored voice memo (step 82), it is played back (annunciated) per the next step 84. This annunciated voice memo is one that was stored with a previous message containing distinctive data that is matched by distinctive data in the present message.

Having read the present message, the user is given the option of deleting it from the message memory 54 per step 86. If the user assents to deletion, the program proceeds to step 88. In this step, the last received message is deleted from the message memory 54, but any stored distinctive data that it contained is preserved in the memo look-up table 52. In this way, a future message containing matching distinctive data can use the voice memo stored in association with the preserved distinctive data. The associated voice memo stored in voice storage element 62 is also preserved, at least temporarily.

In the next step 90, the user is given the option of deleting the voice memo that was annunciated per step 84. If the user denies deletion, this part of the program ends; if the user assents to deletion, the voice memo becomes deleted at step 92.

There will be many situations where an incoming message and its distinctive data are not associated with a previously stored voice memo. However, the user can attach a voice memo for use with future messages having matching distinctive data. The part of the program which gives the user this option begins at step 76 where a decision is made that the present received message does not include distinctive data that matches stored distinctive data for which a voice memo has been stored. The program proceeds from step 76 to step 94 (FIG. 3B) where the user is given a prompt (via display 28) asking whether he wishes to attach a voice memo. If the answer is "no", this part of the program ends, but if the answer is "yes", the program proceeds to step 96. Here, the user speaks a voice memo into the microphone 58. Next, step 98 asks the user whether the message is acceptable to him. If it is not acceptable, the voice memo is deleted and the program repeats steps 96 and 98, giving the user the opportunity to store a different voice memo.

When the voice memo is acceptable, step 100 asks whether the voice storage element 62 is full. If it is not full, the program proceeds to step 104 where the voice memo is stored in association with its distinctive data, the latter being stored in memo look-up table 52. If the memo look-up table is full, step 102 causes a previously stored voice memo to be deleted. The deleted voice memo can be the one that was least recently used or least used. Other criteria can also be used for choosing a voice memo to delete.

An alternate method of storing distinctive data and associated voice memos will now be described. This alternate method can be used in place of the method described above or, preferably, in conjunction with it.

According to this alternate method, the user enters into the SCR's memory known distinctive data, e.g., a known telephone number that is expected to be included in a message to be received in the future. The SCR 10 stores that distinctive data in memory. The user then speaks a voice memo that relates to the distinctive data, and the SCR stores that voice memo in association with the distinctive data. For example, the user expects to receive at least one future message that includes the telephone number "555-1800", and the user knows that that telephone number belongs to his supervisor at work. He enters that telephone number in the SCR's memo look-up table 52 using one or more of the buttons 38–44 in combination with conventional displayed prompts. Upon being prompted as to whether he desires to enter a voice memo, the user speaks, into the microphone 58, the statement "Remember to mention the new product plans". The SCR stores that statement in its voice storage element 62 in association with the telephone number "555-1800".

Later, when transmitted messages are received, the SCR determines whether any of the messages contains distinctive data that matches the distinctive data that was stored in memory. If a match is found, the SCR 10 makes the stored voice memo available for annunciation in explanation of the received message. Preferably, the SCR 10, upon finding matching distinctive data (e.g., the same telephone number), alerts the user via an icon and/or an audible alert that a voice memo is available, and, upon user request, annunciates that voice memo.

It will be appreciated that this alternate method of storing distinctive data and voice memos, and annunciating voice memos generally follows the flow chart of FIG. 3, except for the order in which messages are received and distinctive data and associated voice memos are stored. Any required modification to the flow chart will be obvious to those skilled in the art in view of the forgoing discussion.

It will be appreciated that storing distinctive data and associated voice memos, and making the voice memos available for annunciation, can significantly aid a user of the SCR. The voice memos help the user recall the identity of a person who sent a message, or any other facts that would be significant to the user. The fact that the voice memos are user generated makes the SCR particularly valuable because the user can store customized memos that contain information that is particularly significant to the user, and which can be changed by the user to meet changing circumstances.

Figure 4:
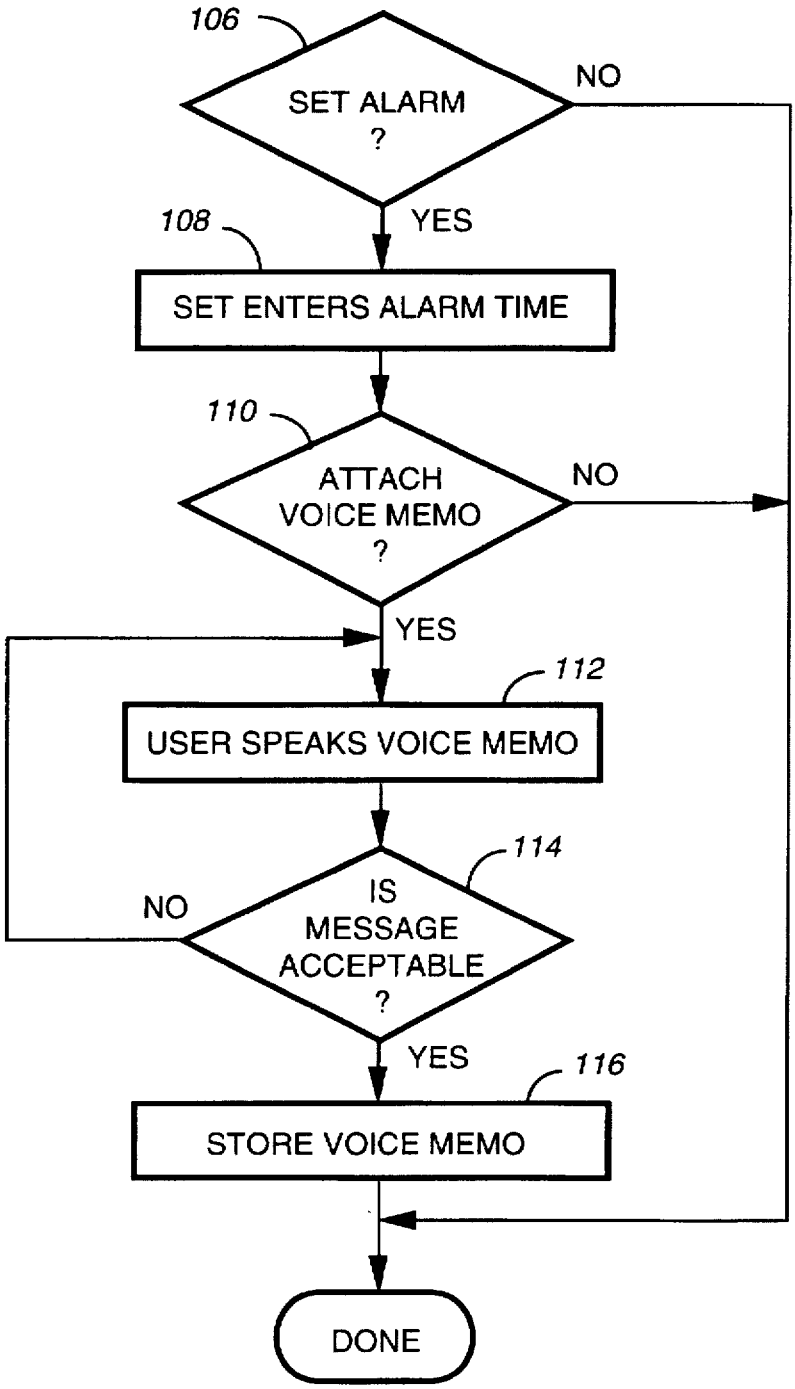

Another aspect of the invention involves storing a voice memo in association with an alarm. According to this aspect of the invention, the user operates the SCR's user control to set an alarm that is to be output at a time designated by the user. The alarm can be output by the speaker 34 generating an alarm sound and/or by the display 28 showing an alarm icon or message. Also, the user speaks a voice memo which is stored in the voice storage element 62 in association with the designated alarm time. When the designated time arrives, the SCR 10 outputs the alarm and annunciates the stored voice memo in explanation of the alarm. An example is described in connection with FIG. 4 which shows how the CPU 20 is preferably programmed to carry out this aspect of the invention.

The program starts with step 106 which causes the display 28 to show the "Set Alarm?" prompt. If the user assents to setting an alarm, he enters the time at which he wishes an alarm to be output (step 108). For example, a user having a meeting at 11 AM may enter an alarm time of 10:45 as a reminder of the meeting. This information is input to the SCR by the user in the same manner as described previously for the entry of a telephone number, and it is stored in the RAM 50. Next, step 110 asks whether a voice memo is to be attached to the designated alarm time. If the answer is "yes", the program proceeds to step 112 where the user speaks a voice memo. Using the previous example, the voice memo may say "Meet Martha at 11 AM."

Step 114 gives the user the opportunity to change the voice memo. If a change is desired, steps 112 and 114 are repeated until the user accepts the voice memo. The accepted memo is then stored (step 116) in voice storage element 62.

Figure 5:
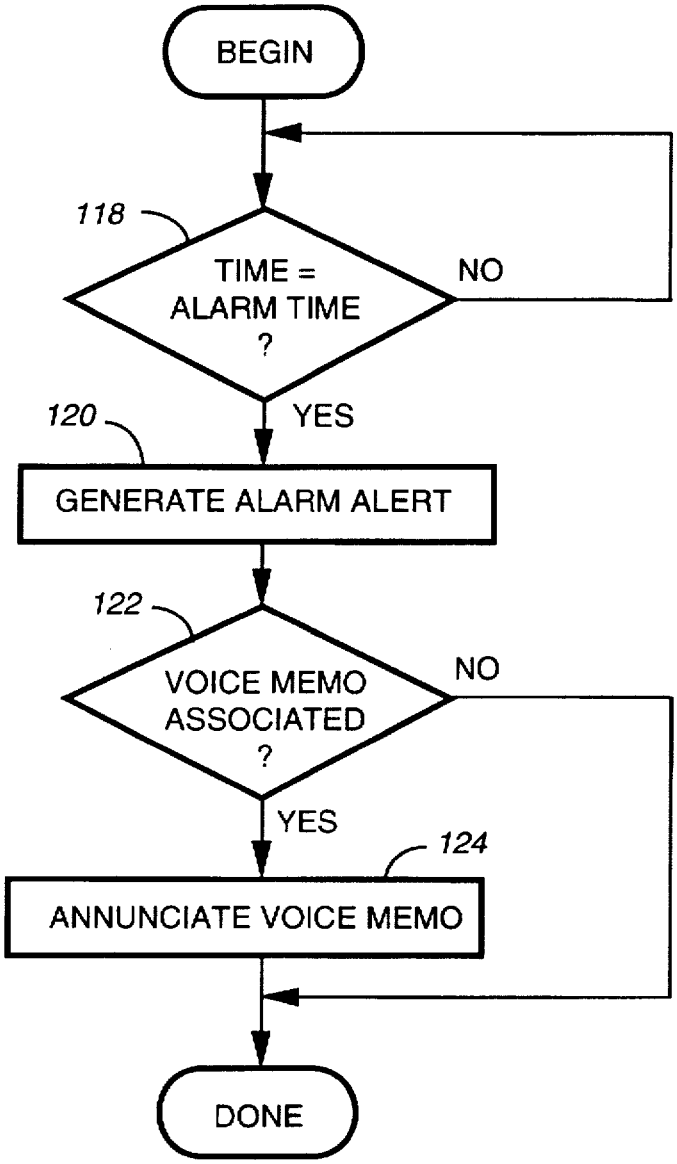

The CPU 20 is programmed to generate an alarm alert and to annunciate an associated voice memo as shown in FIG. 5. At step 118, a determination is made as to whether the present time is equal to the designated time for the alarm. This step repeats until the designated alarm time arrives, at which point step 120 is executed to generate an alarm alert. The next step 122 asks whether a voice memo has been associated with the alarm. If the answer is "yes", the program proceeds to step 124 which causes the associated voice memo to be annunciated.

The use of a voice memo in connection with an alarm clearly enhances the value of the SCR to its user. With this feature, the SCR user need not be concerned with forgetting why an alarm is being generated. His own voice memo annunciates the reason to him, or reminds him of facts that are significant to him. This can be particularly important to users who frequently use an alarm function to remind them of numerous meetings, medicines to take at particular times of day, etc. Combining the voice memo/alarm feature with the ability to annunciate voice memos in explanation of received messages adds further value to the SCR.

Although the invention has been described in terms of a preferred embodiment, it will be obvious to those skilled in the art that many alterations and variations made be made without departing from the invention. Accordingly, it is intended that all such alteration and variations be considered as within the spirit and scope of the invention as defined by the appended claims.

What is claimed is:

1. In a selective call receiver that receives transmitted messages that includes text, a method of providing, to a user of the selective call receiver, information concerning a message, comprising:

receiving a first transmitted message whose text includes distinctive data;, receiving a user-generated voice memo that relates to the first transmitted message; and storing the voice memo and the distinctive data in association with each other.

2. A method as set forth in claim 1 including displaying the first transmitted message before receiving the voice memo.

3. A method as set forth in claim 1 wherein the steps of receiving a user-generated voice memo and storing the voice memo and distinctive data occur prior to receiving the first transmitted message, and further including:

looking for a match between stored distinctive data and distinctive data in the first transmitted message and, if a match is found, annunciating the stored voice memo in explanation of the first transmitted message.

4. A method as set forth in claim 1 including receiving and displaying a second transmitted message that includes the distinctive data, and annunciating the voice memo in explanation of the second transmitted message.

5. A method as set forth in claim 4 including associating the stored voice memo with the distinctive data included in the second transmitted message, and wherein the voice memo is annunciated while the second transmitted message is being displayed.

6. A method as set forth in claim 4 including storing the first transmitted message until the user causes it to be deleted, while saving the distinctive data included in the first transmitted message and its association with the voice memo.

7. A method as set forth in claim 4 including displaying the second transmitted message upon user demand, and generating a user-discernible indication that a voice memo is available for the second transmitted message.

8. A method as set forth in claim 7 wherein the user-discernible indication is an icon.

9. A method as set forth in claim 1 further including:

setting an alarm that is to be output at a designated time; and storing a user-generated alarm voice memo associated with the alarm.

10. A method as set forth in claim 9 further including:

outputting the alarm at the designated time; and annunciating the alarm voice memo in explanation of the alarm.

11. In a selective call receiver that receives transmitted messages that includes text, a method of providing, to a user of the selective call receiver, information concerning a message, comprising:

receiving a first transmitted message whose text includes distinctive data;

displaying the first transmitted message; receiving a user-generated voice memo that relates to the first transmitted message;

storing the voice memo and the distinctive data in association with each other;

receiving and storing a second transmitted message that includes the distinctive data;

displaying the second transmitted message; and annunciating the voice memo in explanation of the second transmitted message.

12. A method as set forth in claim 11 wherein the second transmitted message is displayed upon user demand, along with an icon indicating that a voice memo is available for the second transmitted message.

13. A method as set forth in claim 10 including associating the stored voice memo with the distinctive data included in the second transmitted message, and wherein the voice memo is annunciated while the second transmitted message is being displayed.

14. A method as set forth in claim 11 further including:

setting an alarm that is to be output at a designated time;

storing a user-generated alarm voice memo associated with the alarm;

outputting the alarm at the designated time; and annunciating the alarm voice memo in explanation of the alarm.

15. In a selective call receiver that receives transmitted messages that includes text, a method of providing, to a user of the selective call receiver, information concerning a message, comprising:

receiving from the user distinctive data that is expected to be included in a message to be received in the future, and storing the distinctive data in memory;

receiving a user-generated voice memo that relates to the distinctive data;

storing the voice memo in association with the distinctive data;

receiving a message and determining whether the text of the message contains distinctive data that matches the distinctive data that was stored in memory; and if a match is found, making the stored voice memo available for annunciation in explanation of the received message.

16. A method as set forth in claim 15 further including:

setting an alarm that is to be output at a designated time;

storing a user-generated alarm voice memo associated with the alarm;

outputting the alarm at the designated time; and annunciating the alarm voice memo in explanation of the alarm.

* * * * *